US009856735B2

(12) United States Patent
Yamada et al.

(10) Patent No.: US 9,856,735 B2
(45) Date of Patent: Jan. 2, 2018

(54) METHOD OF MANUFACTURING STEAM TURBINE ROTOR AND STEAM TURBINE ROTOR

(75) Inventors: Masayuki Yamada, Yokohama (JP); Takao Inukai, Kawasaki (JP); Kiyoshi Imai, Taito-Ku (JP); Shigekazu Miyashita, Yokohama (JP); Kuniyoshi Nemoto, Yokohama (JP); Reki Takaku, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 956 days.

(21) Appl. No.: 13/127,517

(22) PCT Filed: Oct. 27, 2009

(86) PCT No.: PCT/JP2009/068412

§ 371 (c)(1),
(2), (4) Date: May 4, 2011

(87) PCT Pub. No.: WO2010/053023

PCT Pub. Date: May 14, 2010

(65) Prior Publication Data

US 2011/0229339 A1 Sep. 22, 2011

(30) Foreign Application Priority Data

Nov. 4, 2008 (JP) ..... 2008-283255

(51) Int. Cl.
*F01D 5/06* (2006.01)

(52) U.S. Cl.
CPC ..... *F01D 5/06* (2013.01); *F05D 2220/31* (2013.01); *Y10T 29/49316* (2015.01)

(58) Field of Classification Search
CPC ... F01D 5/06; F05D 2220/31; Y10T 29/49316
See application file for complete search history.

(56) References Cited

U.S. PATENT DOCUMENTS 5,444,732 A 8/1995 Takenouchi et al.
5,487,082 A 1/1996 Takenouchi et al.
(Continued)

FOREIGN PATENT DOCUMENTS

DE 29 06 371 A1 8/1980
JP 52 1203 1/1977
(Continued)

OTHER PUBLICATIONS

ASTM International, The Materials Information Society vol. 2 Properties and Selection: Nonferrous Alloys and Special-purpose materials, 1990, pp. 430.*
(Continued)

*Primary Examiner* — Jenny R Wu
(74) *Attorney, Agent, or Firm* — Oblon, McClelland, Maier & Neustadt, L.L.P.

(57) ABSTRACT

A method of manufacturing a steam turbine rotor which includes an ultra-high temperature side portion in which ultra-high temperature steam flows and a high temperature side portion in which high temperature steam flows, the manufacturing method including the steps of: preparing a first electrode having a chemical composition corresponding to a chemical composition of a heat resistant alloy making up the ultra-high temperature side portion and a second electrode having a chemical composition corresponding to a chemical composition of the high temperature side portion; tentatively joining together joints of the electrodes, with the joints of the electrodes made smaller in cross sectional area than other electrode portions; subjecting the tentatively joined first and second electrodes to an ESR process to obtain an ESR ingot and forging the ingot into a shape of a rotor to obtain a rotor forging; and heat-treating the rotor forging to obtain a rotor blank and manufacturing the steam turbine rotor from the rotor blank.

9 Claims, 5 Drawing Sheets

(56) References Cited

U.S. PATENT DOCUMENTS

| | | | | |
|---|---|---|---|---|
| 5,524,019 | A | 6/1996 | Takenouchi et al. | |
| 5,944,922 | A * | 8/1999 | Kadoya et al. | 148/325 |
| 6,499,946 | B1 * | 12/2002 | Yamada et al. | 415/199.4 |
| 7,065,872 | B2 | 6/2006 | Ganesh et al. | |
| 2002/0081197 | A1 | 6/2002 | Crawmer | |
| 2008/0166222 | A1 * | 7/2008 | Yamashita et al. | 415/116 |
| 2010/0251713 | A1 * | 10/2010 | Takahashi et al. | 60/670 |

FOREIGN PATENT DOCUMENTS

| | | |
|---|---|---|
| JP | 60 135536 | 7/1985 |
| JP | 6 155001 | 6/1994 |
| JP | 7 305121 | 11/1995 |
| JP | 07305121 A * | 11/1995 |
| JP | 2001 50007 | 2/2001 |

OTHER PUBLICATIONS

Electroslag Remelting Process: Part One Total Materia Article, pp. 3-7 Published in Jun. 2008.*

International Search Report dated Feb. 2, 2010 in PCT/JP09/068412 filed Oct. 27, 2009.

Extended European Search Report dated Feb. 28, 2012 in Application No. 09824723.2.

International Preliminary Report on Patentability and Written Opinion dated Jun. 7, 2011, in PCT/JP2009/068412.

* cited by examiner

| | JOINT SHAPE OF ESR ELECTRODE | TRANSITION WIDTH OF COMPOSITION TRANSITION REGION OF ESR INGOT (RATIO) |
|---|---|---|
| EXAMPLE | FIG. 2 | 0.41 |
| | FIG. 3 | 0.32 |
| | FIG. 4 | 0.28 |
| | FIG. 5 | 0.34 |
| COMPARATIVE EXAMPLE | FIG. 6 | 1 |

FIG. 8

METHOD OF MANUFACTURING STEAM TURBINE ROTOR AND STEAM TURBINE ROTOR

TECHNICAL FIELD

The present invention relates to a method of manufacturing a steam turbine and a steam turbine rotor, and particularly, to a method of manufacturing a steam turbine rotor by utilizing electro-slag remelting (hereinafter referred to as ESR) process and to a steam turbine rotor manufactured by the steam turbine rotor manufacturing method.

BACKGROUND

Generally, a steam turbine rotor is manufactured in a manner of melting and refining raw materials so as to finally obtain a predetermined chemical composition, which are then cast and solidified in a mold, forging a solidified ingot into a shape of the rotor to obtain a rotor forging product, heat-treating the rotor forging product to obtain a rotor blank, machining the rotor blank, and implanting rotor blades in the rotor blank.

Alternatively, a steam turbine rotor may sometimes be manufactured in a manner of melting and refining raw materials as described above, remelting the resulting ingot in an ESR furnace (ESR) by using the ingot as an electrode and then solidifying the same. A resulting ESR ingot is then forged into a rotor forging product, the rotor forging product is heat-treated to obtain a rotor blank, the rotor blank is machined, and rotor blades are implanted in the rotor blank. A main object of performing the ESR is to improve solidification composition, reduce segregation of components, remove impurities, and so on.

Japanese Patent Application Laid-Open Publication No. 6-155001 (Patent Document 1) discloses a technique for manufacturing an integrated high and low pressure turbine rotor by performing an ESR process using a plurality of hollow electrodes having chemical compositions corresponding to chemical compositions of different parts of the steam turbine rotor.

Japanese Patent Application Laid-Open Publication Nos. 2001-50007 and 2001-50002 (Patent Documents 2 and 3) also disclose techniques for manufacturing a high, medium, and low pressure turbine rotor as well as a low pressure turbine rotor by combining partial rotor blanks of different chemical compositions using the ESR process.

Incidentally, in a thermal plant including a steam turbine, attention is paid to techniques for carbon dioxide emission control in terms of global environment protection, and there is a growing need for more efficient power generation. To improve generation efficiency of a steam turbine, it is useful to increase a turbine steam temperature, and a steam temperature of 600° C. or higher has come to be used recently in a thermal power generation plant equipped with a steam turbine. There is a tendency that the steam temperature rises to 650° C., 700° C., or even above 700° C. in the future.

With such increases in the temperature, the steam turbine rotor applied tends to switch to heat-resistant alloys such as Ni-based superalloys having better high-temperature strength than ferritic heat resistant steels (such as 1% Cr—Mo—V steel or 12% Cr steel), which have insufficient high-temperature strength. However, with such heat-resistant alloys, due to limitations of melting facilities, production on the order of ten-odd tons is a limit in terms of product weight. Further, heat-resistant alloys are higher in cost than ferritic heat resistant steels.

Thus, it is also necessary to keep down the cost of the entire steam turbine rotor by minimizing the scope of application of the heat-resistant alloys. Because of this purpose, rather than as a monoblock structure, it is useful to build the steam turbine rotor as a joined structure of a heat-resistant alloy and ferritic heat resistant steel by using the right materials in the right place.

Possible joined structures for the above purpose include a welded joint and bolted joint. The welded joint has many problems to be solved from the viewpoint of rotor design and long-term reliability, including weld defects, welding deformation, and welding residual stress which may occur in the joint. On the other hand, the bolted joint requires a larger rotor wheel interval in the joint than an optimum design interval, resulting in performance degradation of the steam turbine rotor. Further, the bolted joint is not applicable to a drum rotor structure though applicable to a wheel structure.

DISCLOSURE OF THE INVENTION

In view of the above circumstances, a first object of the present invention is to provide a steam turbine rotor manufacturing method capable of manufacturing a steam turbine rotor for an ultra-high temperature steam turbine using heat-resistant alloy with excellent high-temperature characteristics by overcoming limitations of manufacturing techniques as well as to provide a steam turbine rotor resulting from application of the manufacturing method.

A second object of the present invention is to provide a steam turbine rotor manufacturing method capable of manufacturing a high-quality steam turbine rotor for an ultra-high temperature steam turbine at low costs as well as to provide a steam turbine rotor resulting from application of the manufacturing method.

To achieve the above objects, the present invention provides a method of manufacturing a steam turbine rotor which includes an ultra-high temperature side portion in which ultra-high temperature steam flows and a high temperature side portion in which high temperature steam flows, the steam turbine rotor manufacturing method including the steps of: preparing a first electrode having a chemical composition corresponding to a chemical composition of a heat resistant alloy making up the ultra-high temperature side portion and a second electrode having a chemical composition corresponding to chemical composition of the high temperature side portion; providing joints on peripheral edges at longitudinal ends of the first and second electrodes; tentatively joining together the joints of the first and second electrodes, with portions including the joints of the first and second electrodes made smaller in cross sectional area than other electrode portions; subjecting the tentatively joined first and second electrodes to electro-slag remelting, and forging a resulting electro-slag remelted ingot into a shape of a rotor to obtain a rotor forging; and subsequently heat-treating the rotor forging to obtain a rotor blank and manufacturing the steam turbine rotor from the rotor blank.

The above-described steam turbine rotor manufacturing method may have following preferred modes.

It may be desired that the chemical composition of the second electrode is different from the chemical composition of the first electrode and the chemical composition of the high temperature side portion of the steam turbine rotor is different from the chemical composition of the ultra-high temperature side portion.

It may be desired that the high temperature side portion is made of a ferritic heat resistant steel.

In the heat treatment of the rotor forging, the ultra-high temperature side portion and the high temperature side portion may be heat-treated simultaneously under heat treatment conditions predetermined according to the respective chemical compositions.

Furthermore, desirably, the chemical composition of the second electrode may be the same as the chemical composition of the first electrode and the high temperature side portion of the steam turbine rotor is made of a same heat resistant alloy as the ultra-high temperature side portion.

Furthermore, it may be also desired that, in the heat treatment of the rotor forging, the ultra-high temperature side portion and the high temperature side portion are heat-treated simultaneously under same heat treatment conditions.

The heat resistant alloy making up the ultra-high temperature side portion may be an Ni-based superalloy.

The first and second electrodes have a solid structure and only the joints thereof may be formed so as to provide a ring shape.

Furthermore, preferably, the first and second electrodes have a solid structure and the joints thereof are configured such that only portions on an outer peripheral side of the electrodes protrude in an axial direction.

Furthermore, it may be also desired that the first and second electrodes have a solid structure and the joints thereof are configured such that only portions on a central side of the electrodes protrude in an axial direction.

The steam turbine rotor may be one of a high pressure turbine rotor, an intermediate pressure turbine rotor, and an integrated high and intermediate pressure turbine rotor.

On the other hand, the objects of the present invention can also be achieved by the steam turbine rotor manufactured by the steam turbine rotor manufacturing method according to claim 1.

More specifically, a steam turbine rotor for a steam turbine configured to be equipped with one of a high pressure turbine rotor, an intermediate pressure turbine rotor, and an integrated high and intermediate pressure turbine rotor, includes a rotor body, bearing portions installed on opposite sides of the rotor body, and a plurality of turbine rotor blades installed on the rotor by being disposed in a circumferential direction of the steam turbine rotor, wherein the steam turbine rotor further includes an ultra-high temperature side portion in which ultra-high temperature steam flows and a high temperature side portion in which high temperature steam flows; and the steam turbine rotor is manufactured by providing joints on peripheral edges at longitudinal ends of a first electrode having a chemical composition corresponding to a chemical composition of a heat resistant alloy making up the ultra-high temperature side portion and a second electrode having a chemical composition corresponding to a chemical composition of the high temperature side portion, tentatively joining together the joints of the first and second electrodes, with portions including the joints of the first and second electrodes made smaller in cross sectional area than other electrode portions, subjecting the tentatively joined first and second electrodes to electro-slag remelting, and forging a resulting electro-slag remelted ingot into a shape of a rotor to obtain a rotor forging, and subsequently heat-treating the rotor forging to obtain a rotor blank, machining the rotor blank and implanting the rotor blades to manufacture the steam turbine rotor.

With the steam turbine rotor manufacturing method and the steam turbine rotor according to the present invention, the first electrode is produced by melting a heat resistant alloy, an electro-slag remelted ingot is obtained by subjecting the first electrode and the other second electrode to electro-slag remelting, and the steam turbine rotor is manufactured after passing through stages of a rotor forging and a rotor blank in sequence. Consequently, the steam turbine rotor can be manufactured by overcoming limitations in the manufacturing technique of the heat resistant alloy such as inability to produce a large-size part. Furthermore, since the ultra-high temperature side portion of the steam turbine rotor is made of the heat resistant alloy with excellent high-temperature strength, soundness of the steam turbine rotor can be ensured even against ultra-high temperature steam in excess of 600° C.

BRIEF DESCRIPTION OF THE DRAWINGS

FIG. 8 is a chart showing transition widths of composition transition regions of ESR ingots produced by using the joined structures of the electrodes in the examples in FIGS. 2 to 6 in comparison with the comparative example.

BEST MODE FOR CARRYING OUT THE INVENTION

The best mode for carrying out the present invention will be described hereunder with reference to the accompanying drawings.

(1) First Embodiment (FIGS. 1 to 8)

Figure 1:
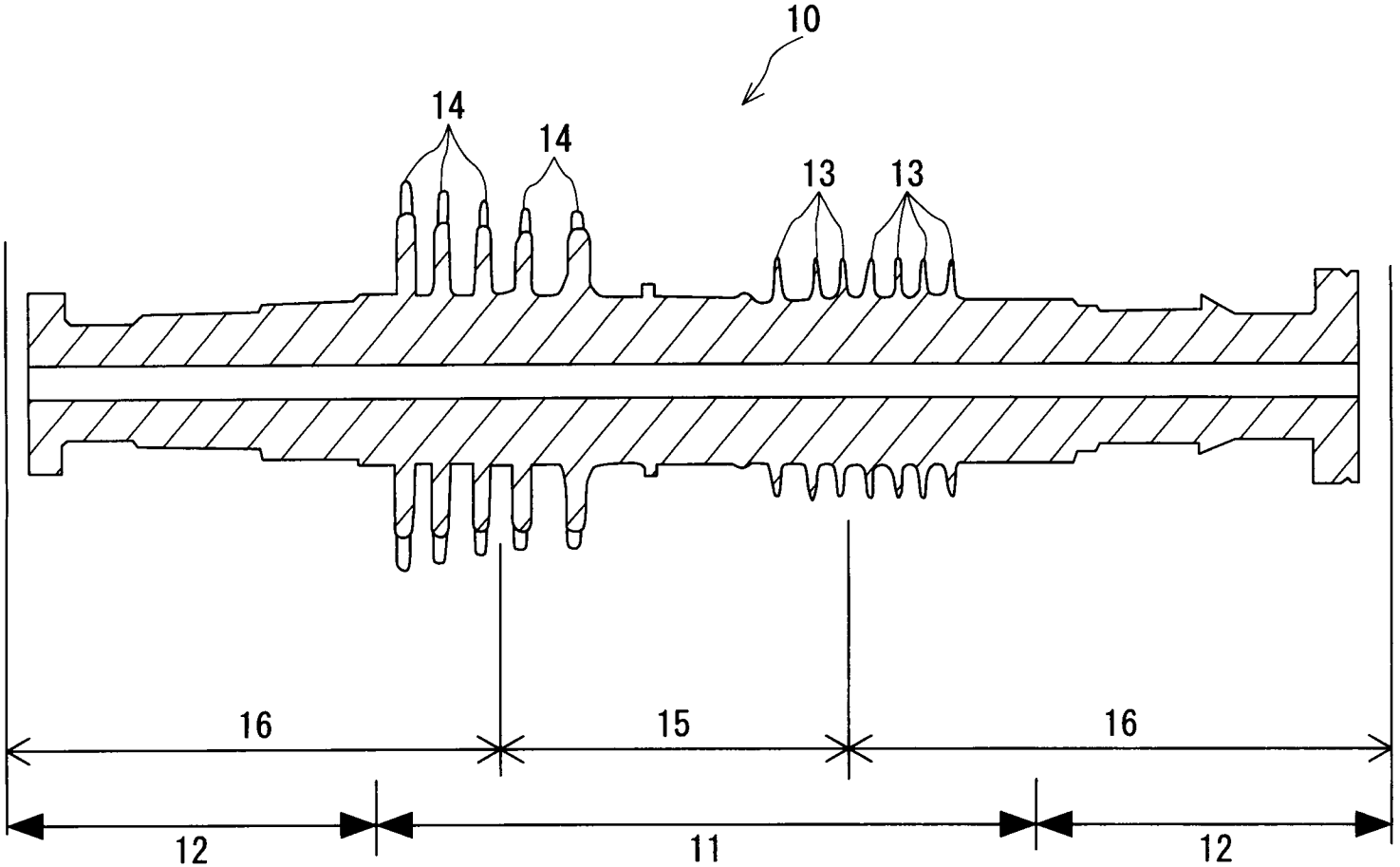
FIG. 1 is a schematic sectional view showing a steam turbine rotor manufactured by a steam turbine rotor manufacturing method according to a first embodiment of the present invention.

A steam turbine rotor 10 shown in FIG. 1 is an integrated high and intermediate pressure turbine rotor, which includes a rotor body 11 and bearing portions 12 installed on opposite sides of the rotor body 11. High pressure turbine rotor blades 13 and intermediate pressure turbine rotor blades 14 are implanted in the rotor body 11. In the rotor body 11, a plurality of the high pressure turbine rotor blades 13 are arranged in a circumferential direction of the steam turbine rotor 10 and a plurality of such arrangements are provided in multiple stages along an axial direction of the steam turbine rotor 10. Further, in the rotor body 11, a plurality of the intermediate pressure turbine rotor blades 14 are arranged in the circumferential direction of the steam turbine rotor 10 and a plurality of such arrangements are provided in multiple stages along the axial direction of the steam turbine rotor 10.

The steam turbine rotor 10 described above is exposed to ultra-high temperature steam in excess of 600° C. The ultra-high temperature steam flows to upstream stages (multiple stages closer to the center in FIG. 1) of the high pressure turbine rotor blades 13 and upstream stages (multiple stages closer to the center in FIG. 1) of the intermediate pressure turbine rotor blades 14. Thus, in the rotor body 11 of the steam turbine rotor 10, an ultra-high temperature side portion 15 which includes a portion where the ultra-high temperature steam flows is made of an Ni-based alloy which is a heat resistant alloy with excellent high-temperature strength (e.g., high-temperature creep rupture strength).

Preferable Ni-based alloys include an alloy known under the trade name of IN617 (13Co-22Cr-9Mo-1Al-0.3Ti-54.7Ni [wt %]) and an alloy known under the trade name of IN625 (22Cr-9Mo-3.6Nb-0.2Al-0.2Ti-65Ni[wt %]).

A high temperature side portion 16 of the steam turbine rotor 10 includes the part of the rotor body 11 in which steam not higher than 600° C. flows as well as the bearing portions 12. The high temperature side portion 16 is made of a material, such as a ferritic heat resistant steel having chemical composition different from that of the ultra-high temperature side portion 15.

Preferable ferritic heat resistant steels include, for example, 12% Cr steel (10.5Cr-1Mo-0.2V-0.07Nb-0.05N-1W-87.18Fe[wt %]) and 1% Cr—Mo—V steel (1Cr-1.25Mo-0.25V-97.5Fe[wt %]).

Incidentally, although an integrated high and intermediate pressure turbine rotor is shown in FIG. 1 as an example of the steam turbine rotor 10, a high pressure turbine rotor or intermediate pressure turbine rotor may be used alternatively.

Next, a manufacturing process of the above-described steam turbine rotor 10 will be described hereunder.

In the manufacturing process, raw materials of the Ni-based superalloy for the ultra-high temperature side portion 15 are melted (including refining) so as to provide a predetermined chemical composition, and then, the raw materials are solidified to produce and prepare a first electrode 17 (FIG. 5) having chemical composition corresponding to the chemical composition of the Ni-based superalloy. Furthermore, raw materials of the ferritic heat resistant steel for the high temperature side portion 16 are melted (including refining) so as to provide a predetermined chemical composition, and then, the raw materials are solidified to produce and prepare a second electrode 18 (FIG. 5) having chemical composition corresponding to the chemical composition of the ferritic heat resistant steel.

The first electrode 17 and the second electrode 18 have different chemical compositions as described above. However, both are used for the ESR process. A joint 19A of the first electrode 17 and a joint 20A of the second electrode 18 are configured to be smaller in cross sectional area than the other portions of the first electrode 17 and the second electrode 18, respectively.

Figure 2:
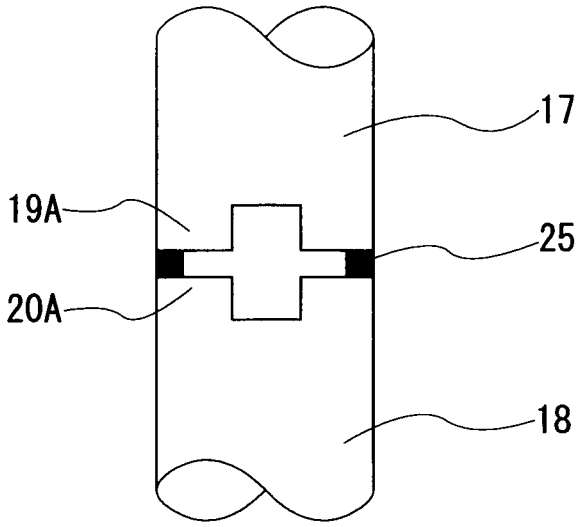
FIG. 2 is a partial schematic side view showing a first example of a joined structure of electrodes used for ESR in manufacturing the steam turbine rotor shown in FIG. 1.

For example, as shown in FIG. 2, the first electrode 17 and the second electrode 18 have a solid structure, and only the joint 19A and the joint 20A are formed into a ring shape (first example).

Figure 3:
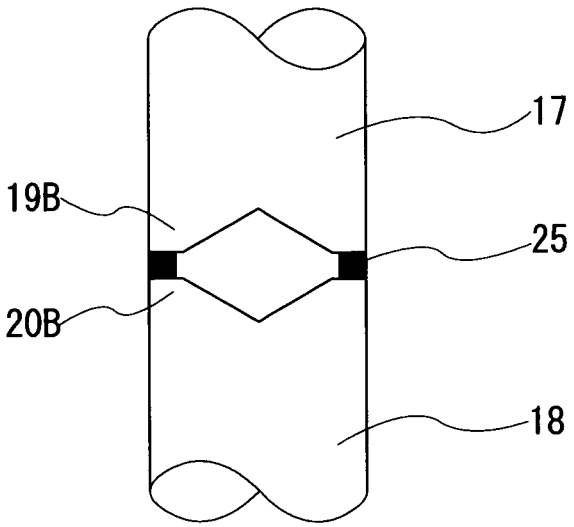
FIG. 3 is a partial schematic side view showing a second example of a joined structure of electrodes used for ESR in manufacturing the steam turbine rotor shown in FIG. 1.

As shown in FIG. 3, also, the first electrode 17 and the second electrode 18 have a solid structure, and a joint 19B of the first electrode 17 and a joint 20B of the second electrode 18 are configured such that only portions on an outer peripheral side of each electrode protrude in an axial direction with inner sides of the joints 19B and 20B formed into slopes (second example).

Figure 4:
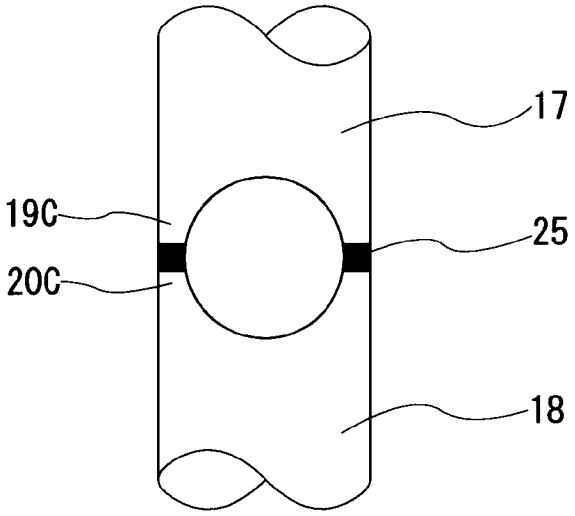
FIG. 4 is a partial schematic side view showing a third example of a joined structure of electrodes used for ESR in manufacturing the steam turbine rotor shown in FIG. 1.

Furthermore, as shown in FIG. 4, the first electrode 17 and the second electrode 18 have a solid structure, and a joint 19C of the first electrode 17 and a joint 20C of the second electrode 18 are configured such that only portions on the outer peripheral sides of the electrodes protrude in the axial direction with inner sides of the joints 19C and 20C formed into hemispherical shapes (third example).

Figure 5:
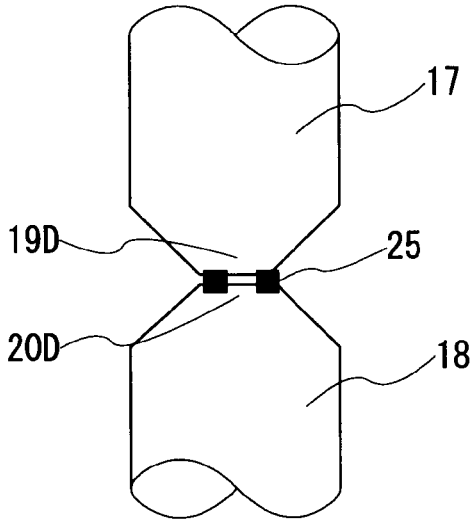
FIG. 5 is a partial schematic side view showing a fourth example of a joined structure of electrodes used for ESR in manufacturing the steam turbine rotor shown in FIG. 1.

Further, as shown in FIG. 5, the first electrode 17 and the second electrode 18 have a solid structure, and a joint 19D of the first electrode 17 and a joint 20D of the second electrode 18 are configured such that only central portions of the electrodes protrude in the axial direction (fourth example).

Figure 7:
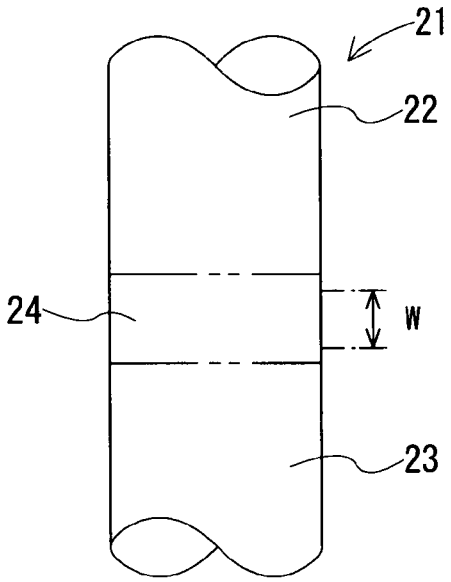
FIG. 7 is a schematic side view showing an ESR ingot created by ESR.

In the next process, the joint (19A, 19B, 19C, or 19D) of the first electrode 17 and the joint (20A, 20B, 20C, or 20D) of the second electrode 18 are fastened together tentatively, for example, by welding, the first electrode 17 and the second electrode 18 are mounted in an ESR furnace. Tentative joint locations are denoted by 25 in FIGS. 2 to 5. The tentatively joined first electrode 17 and second electrode 18 are subjected to an ESR process to produce an ESR ingot 21 (FIG. 7).

The ESR ingot 21 includes an ultra-high temperature side portion 22 made of an Ni-based superalloy, a high temperature side portion 23 made of a ferritic heat resistant steel, and a composition transition region 24 in which constituent elements of the Ni-based superalloy and constituent elements of the ferritic heat resistant steel coexist.

Herein, a transition width W of the composition transition region 24 is defined as a range in which there is a 20% or more difference in the contents of constituent elements from the ultra-high temperature side portion 22 and the high temperature side portion 23, where the range is expressed in length along a longitudinal direction of the ESR ingot 21. For example, if the content of element A in the high temperature side portion 23 is 5% and the content of the same element, i.e., element A, in the ultra-high temperature side portion 22 is 10%, the transition width W of the composition transition region 24 is defined to be the width of the range in which the content of element A in the composition transition region 24 is 6% to 8%. In this case, each constituent element of the ESR ingot 21 has a different distribution pattern. Therefore, a value of the transition width W is determined for each constituent element and the largest one of these values is adopted as the transition width W of the composition transition region 24.

Figure 6:
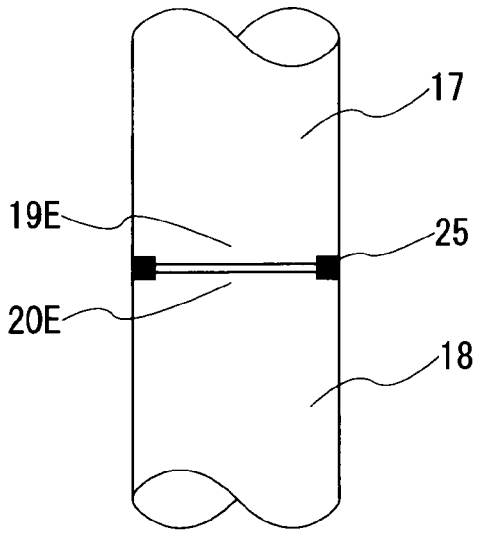
FIG. 6 is a partial schematic side view showing a comparative example of a joined structure of electrodes used for ESR in manufacturing a steam turbine rotor.

Incidentally, when the effects of various characteristics of the composition transition region 24 are considered, from the viewpoint of ensuring the reliability of long-term operation of the steam turbine rotor 10, preferably the composition transition region 24 has a small transition width W. For example, supposing that the first electrode 17 is made of IN617 and the second electrode 18 is made of 12% Cr steel, and that the transition width W of the composition transition region 24 of an ESR ingot 21 produced by the ESR process is taken as "1" when a joint 19E of the first electrode 17 and a joint 20E of the second electrode 18 are placed in complete contact with each other, as shown in FIG. 6, by being welded together tentatively at a tentative fastening location 25 on the outer periphery. Then, as shown in FIG. 8, the transition width W of the composition transition region 24 in the ESR ingot 21 is 0.41 with the joined structure shown in FIG. 2, 0.32 with the joined structure shown in FIG. 3, 0.28 with the joined structure shown in FIG. 4, and 0.34 with the joined structure shown in FIG. 5, all of which are not more than half the value obtained by the joined structure shown in FIG. 6.

Next, the ESR ingot 21 produced as described above is forged into a shape of a rotor to produce a rotor forging, not shown, and subsequently the rotor forging is heat-treated to produce a rotor blank, not shown.

In the heat treatment of the rotor forging, the ultra-high temperature side portion (with the same chemical composition as the ultra-high temperature side portion 22 in FIG. 7) and the high temperature side portion (with the same chemical composition as the high temperature side portion 23 in FIG. 7) are heat-treated simultaneously under heat treatment conditions suitable (preferably, optimal) for the respective chemical compositions. For example, the ultra-high temperature side portion and the high temperature side portion of the rotor forging are heated simultaneously at different heating temperatures and cooled simultaneously at different cooling rates.

Subsequently, the rotor blank created by the heat treatment mentioned above is machined, and the rotor blades 13 and 14 are implanted to produce the steam turbine rotor 10 shown in FIG. 1.

According to the configuration or structure described above, the present embodiment provides the following advantageous effects (1) to (8).

(1) The first electrode 17 is produced by melting a Ni-based superalloy, the ESR ingot 21 is obtained by subjecting the first electrode 17 and the second electrode 18 to the ESR, and the steam turbine rotor 10 is then produced after going through stages of a rotor forging and a rotor blank in sequence, so that the present embodiment can produce the steam turbine rotor by overcoming limitations in the manufacture of the Ni-based superalloy such as inability to produce a large-size parts.

(2) Since the ultra-high temperature side portion 15 of the steam turbine rotor 10 is made of an Ni-based superalloy with excellent high-temperature strength, the present embodiment can ensure soundness of the steam turbine rotor 10 even against ultra-high temperature steam in excess of 600° C.

(3) Although the first electrode 17 for the ESR is made of an expensive Ni-based superalloy, since the second electrode 18 is made of ferritic heat resistant steel, the present embodiment can produce the steam turbine rotor 10 at low cost after a stage of the ESR ingot 21 produced by using the first electrode 17 and the second electrode 18.

(4) The joint (19A, 19B, 19C, or 19D) of the first electrode 17 and the joint (20A, 20B, 20C, or 20D) of the second electrode 18 are configured to be smaller in cross sectional area than the other parts of the first electrode 17 and the second electrode 18, respectively. Therefore, in the ESR using the first electrode 17 and the second electrode 18, the present embodiment can decrease meltage of the joint (19A, 19B, 19C, or 19D) and the joint (20A, 20B, 20C, or 20D), resulting in a shallow melt pool, thereby allowing the melt pool to be flattened and solidification speed to be increased. This allows the transition width W of the composition transition region 24 in the ESR ingot 21 to be reduced, making it possible to increase the quality of the steam turbine rotor 10 manufactured by passing through a stage of the ESR ingot 21 and improve the reliability of the long-term operation of the steam turbine rotor 10.

(5) Since the joint (19A, 19B, 19C, or 19D) of the first electrode 17 and the joint (20A, 20B, 20C, or 20D) of the second electrode 18 are configured to be smaller in cross sectional area than the other parts of the first electrode 17 and the second electrode 18, respectively, the first electrode 17 and the second electrode 18 can be shortened in comparison with a case of both the electrodes being hollow. This makes it possible to downsize the ESR furnace and the like in which the first electrode 17 and the second electrode 18 are mounted.

(6) In the heat treatment of the rotor forging, the ultra-high temperature side portion (with the same chemical composition as the ultra-high temperature side portion 22 in FIG. 7) and the high temperature side portion (with the same chemical composition as the high temperature side portion 23 in FIG. 7) with different chemical compositions are heat-treated simultaneously under the heat treatment conditions optimal for the respective chemical compositions. This makes it possible to fully exploit material properties in the ultra-high temperature side portion and the high temperature side portion of the rotor forging.

(7) In the steam turbine rotor 10, the ultra-high temperature side portion 15 made of the Ni-based superalloy and the high temperature side portion 16 made of the ferritic heat resistant steel are joined by using an ESR process. Accordingly, since no welded joint or bolted joint is used, it is possible to eliminate technical problems resulting from joining, including defective conditions (such as welding deformation or welding residual stress) caused by welding and defective conditions (such as an increased rotor wheel interval or an incompatible drum rotor structure) caused by bolted joints.

(8) Furthermore, the examples of the present invention excel at tentative joining of peripheral portions. That is, in comparison with the tentative joining which involves a central portion, the tentative joining of the peripheral portion has the advantages of making it easy to hold the electrodes, increasing stability of strength, providing high stability against fluctuations of a molten metal level during ESR joining, and minimizing the possibility that an axis of the unmelted portion will be shifted or the unmelted portion will fall off in the middle of ESR process.

(2) Second Embodiment

In the second embodiment, components similar to those in the first embodiment are denoted by the same reference numerals as the corresponding components, and description thereof will be simplified or omitted.

The present embodiment differs from the first embodiment in that: the ultra-high temperature side portion 15 and the high temperature side portion 16 of the steam turbine rotor 10 are made of the same heat resistant alloy, e.g., a Ni-based superalloy, and thus both the first electrode 17 and the second electrode 18 used for ESR manufacturing of the steam turbine rotor 10 have a chemical composition corresponding to the chemical composition of the Ni-based superalloy.

In this case, both the ultra-high temperature side portion 22 and the high temperature side portion 23 of the ESR ingot 21 produced by the ESR process by using the first electrode 17 and the second electrode 18 are made of the Ni-based superalloy, and thus, there is no composition transition region 24.

Therefore, the ultra-high temperature side portion and the high temperature side portion of the rotor forging produced by forging the ESR ingot 21 are heat-treated (heated or cooled) simultaneously under the heat treatment conditions optimal for the Ni-based superalloy. Incidentally, in the present embodiment, the joint (19A, 19B, 19C, or 19D) and the joint (20A, 20B, 20C, or 20D) may be formed on the first electrode 17 and second electrode 18 for ESR, respectively, or the joint 19E and the joint 20E may be formed alternatively.

Thus, the present embodiment provides advantages similar to advantages (1), (2), (5), (7), and (8) of the first embodiment.

It is to be noted that the present invention has been described with reference to the above embodiments, the present invention is not limited to these embodiments. For example, although in the present embodiment, the heat resistant alloy making up the ultra-high temperature side portion 15 is a Ni-based superalloy, a ferritic heat resistant steel having the same chemical composition, or different from, the high temperature side portion 16 may be used.

The invention claimed is:

1. A method of manufacturing a steam turbine rotor which includes an ultra-high temperature side portion in which ultra-high temperature steam flows and a high temperature side portion in which high temperature steam, having a temperature lower than the ultra-high temperature steam, flows, the steam turbine rotor manufacturing method comprising the steps of:

preparing a first electrode having a solid structure and a chemical composition corresponding to a chemical composition of a heat resistant alloy making up the ultra-high temperature side portion and a second electrode having a solid structure and a chemical composition corresponding to a chemical composition of the high temperature side portion;

providing joints on peripheral edges at facing longitudinal end surfaces of the first and second electrodes, wherein the joints are configured such that each joint located only on an outer periphery of the respective electrode protrudes in an axial direction relative to the longitudinal end surfaces;

tentatively joining together the joints of the first and second electrodes, wherein the tentatively joined joints of the first and second electrodes have a cross sectional area smaller than the cross sectional area of the facing longitudinal end surfaces;

subjecting the tentatively joined first and second electrodes to electro-slag remelting so that the tentatively joined joints of the first and second electrodes are eliminated, forging a resulting electro-slag remelted ingot into a shape of a rotor to obtain a rotor forging; and subsequently heat-treating the rotor forging to obtain a rotor blank and manufacturing the steam turbine rotor from the rotor blank.

2. The steam turbine rotor manufacturing method according to claim 1, wherein the chemical composition of the second electrode is different from the chemical composition of the first electrode and the chemical composition of the high temperature side portion of the steam turbine rotor is different from the chemical composition of the ultra-high temperature side portion.

3. The steam turbine rotor manufacturing method according to claim 2, wherein the high temperature side portion is made of a ferritic heat resistant steel.

4. The steam turbine rotor manufacturing method according to claim 2, wherein in the heat treatment of the rotor forging, the ultra-high temperature side portion and the high temperature side portion are heat-treated simultaneously under heat treatment conditions predetermined according to the respective chemical compositions.

5. The steam turbine rotor manufacturing method according to claim 1, wherein the chemical composition of the second electrode is same as the chemical composition of the first electrode, and the high temperature side portion of the steam turbine rotor is made of a same heat resistant alloy as the ultra-high temperature side portion.

6. The steam turbine rotor manufacturing method according to claim 5, wherein in the heat treatment of the rotor forging, the ultra-high temperature side portion and the high temperature side portion are heat-treated simultaneously under same heat treatment conditions.

7. The steam turbine rotor manufacturing method according to claim 1, wherein the heat resistant alloy making up the ultra-high temperature side portion is an Ni-based superalloy.

8. The steam turbine rotor manufacturing method according to claim 1, wherein the steam turbine rotor is one of a high pressure turbine rotor, an intermediate pressure turbine rotor for a turbine having a pressure lower than the turbine of the high pressure turbine rotor, and an integrated high and intermediate pressure turbine rotor.

9. The steam turbine rotor manufacturing method according to claim 1, wherein the facing longitudinal end surfaces of the first and second electrodes located between the tentatively joined joints are separated from one another to form a gap.

* * * * *